US011851634B2

(12) United States Patent
Piorkowski

(10) Patent No.: US 11,851,634 B2
(45) Date of Patent: Dec. 26, 2023

(54) DETERGENT COMPOSITION HAVING REDUCED TURBIDITY

(71) Applicant: HENKEL IP & HOLDING GmbH, Duesseldorf (DE)

(72) Inventor: Daniel Thomas Piorkowski, Stamford, CT (US)

(73) Assignee: HENKEL IP & HOLDING GMBH, Duesseldorf (DE)

( * ) Notice: Subject to any disclaimer, the term of this patent is extended or adjusted under 35 U.S.C. 154(b) by 403 days.

(21) Appl. No.: 17/122,086

(22) Filed: Dec. 15, 2020

(65) Prior Publication Data

US 2022/0186143 A1 Jun. 16, 2022

(51) Int. Cl.

| | |
|---|---|
| ***C11D 1/00*** | (2006.01) |
| ***C11D 1/831*** | (2006.01) |
| ***C11D 3/04*** | (2006.01) |
| ***C11D 3/37*** | (2006.01) |
| *C11D 1/22* | (2006.01) |
| *C11D 1/29* | (2006.01) |
| *C11D 1/72* | (2006.01) |

(52) U.S. Cl.

CPC ..... *C11D 1/831* (2013.01); *C11D 3/046* (2013.01); *C11D 3/3796* (2013.01); *C11D 1/22* (2013.01); *C11D 1/29* (2013.01); *C11D 1/72* (2013.01)

(58) Field of Classification Search

CPC ..... C11D 3/3796

See application file for complete search history.

(56) References Cited

U.S. PATENT DOCUMENTS

| | | | |
|---|---|---|---|
| 4,844,821 | A | 7/1989 | Mermelstein et al. |
| 4,913,828 | A | 4/1990 | Caswell et al. |
| 5,073,274 | A | 12/1991 | Caswell |
| 6,369,018 | B1 | 4/2002 | Hsu et al. |
| 6,616,705 | B2 | 9/2003 | Kischkel et al. |
| 6,620,209 | B2 | 9/2003 | Kischkel et al. |
| 6,949,498 | B2 | 9/2005 | Murphey et al. |
| 7,056,879 | B2 | 6/2006 | Wang et al. |

(Continued)

FOREIGN PATENT DOCUMENTS

| | | | |
|---|---|---|---|
| DE | 102017209211 | A1 | 12/2018 |
| WO | 9731998 | A1 | 9/1997 |

(Continued)

*Primary Examiner* — Necholus Ogden, Jr.

(74) *Attorney, Agent, or Firm* — Lorenz & Kopf, LLP

(57) ABSTRACT

A detergent composition includes:

A. a co-polymer of diallyldimethylammonium chloride and acrylic acid in an amount of from about 0.05 to about 1 weight percent actives;

B. sodium and/or potassium chloride in an amount of greater than about 0.5 up to about 5 weight percent actives;

C. a surfactant component in an amount of from about 8 to about 30 weight percent actives and comprising:

(1) an alcohol ethoxy sulfate in an amount of from about 0 to about 60 weight percent actives;

(2) an alkoxylated alcohol in an amount of from about 0 to about 90 weight percent actives;

(3) a linear alkylbenzene sulfonate in an amount of from about 0 to about 90 weight percent actives;

wherein at least two of said (1) alcohol ethoxy sulfate, said (2) alkoxylated alcohol, and said (3) linear alkylbenzene sulfonate are present in an amount of greater than zero; and D. water.

16 Claims, 2 Drawing Sheets

(56) References Cited

U.S. PATENT DOCUMENTS

| | | | | |
|---|---|---|---|---|
| 7,772,175 | B2 | 8/2010 | Panandiker et al. | |
| 8,177,857 | B2 * | 5/2012 | Creamer | C11D 3/3796 510/357 |
| 8,263,544 | B2 | 9/2012 | Panandiker et al. | |
| 2002/0055451 | A1 | 5/2002 | Kischkel et al. | |
| 2004/0121930 | A1 | 6/2004 | Wang et al. | |
| 2010/0120655 | A1 | 5/2010 | Kischkel et al. | |
| 2010/0197552 | A1 | 8/2010 | Koyuncu et al. | |
| 2015/0376552 | A1 | 12/2015 | Si et al. | |
| 2017/0369818 | A1 * | 12/2017 | Park | C11D 1/29 |

FOREIGN PATENT DOCUMENTS

| | | | |
|---|---|---|---|
| WO | 0070005 | A1 | 11/2000 |
| WO | 2006012984 | A1 | 2/2006 |
| WO | 2019014086 | A1 | 1/2019 |
| WO | 2019084375 | A1 | 5/2019 |

* cited by examiner

DETERGENT COMPOSITION HAVING REDUCED TURBIDITY

TECHNICAL FIELD

The present disclosure generally relates to a detergent composition that includes a DADMAC-acrylic acid copolymer and has a reduced turbidity. More specifically, this disclosure relates to use of sodium and/or potassium salts in conjunction with particular surfactants to unexpectedly reduce turbidity in the aforementioned composition.

BACKGROUND

Softening textiles through the wash is a desirable benefit for consumers. Chemistries that provide this benefit are typically cationically charged and may be unstable when added to a detergent composition containing anionic and nonionic surfactants. For example, when added to such compositions, cationic chemistries can lead to excess turbidity in solutions which reduces usefulness and commercial desirability.

More specifically, commercially available DADMAC-acrylic acid co-polymers can be unstable in many current surfactant compositions. Low water content formulas, such as unit dose formulations, do not tend to exhibit this instability and the solutions tend to remain clear. However, upon addition of such copolymers to high water content detergent compositions, the compositions become cloudy indicating instability.

Accordingly, there remains an opportunity for improvement. Furthermore, other desirable features and characteristics of the present disclosure will become apparent from the subsequent detailed description of the disclosure and the appended claims, taken in conjunction this background of the disclosure.

SUMMARY

This disclosure provides a detergent composition comprising:

A. a co-polymer of diallyldimethylammonium chloride and acrylic acid present in an amount of from about 0.05 to about 1 weight percent actives based on a total weight of the composition;

B. sodium and/or potassium chloride present in an amount of greater than about 0.5 up to about 5 weight percent actives based on a total weight of the composition;

C. a surfactant component present in an amount of from about 8 to about 30 weight percent actives based on a total weight of the composition and comprising:

(1) an alcohol ethoxy sulfate having a C8-C20 backbone that is ethoxylated with from about 1 to about 10 moles of ethylene oxide and present in an amount of from about 0 to about 60 weight percent actives based on a total weight of the surfactant component;

(2) an alkoxylated alcohol present in an amount of from about 0 to about 90 weight percent actives based on a total weight of the surfactant component;

(3) a linear alkylbenzene sulfonate present in an amount of from about 0 to about 90 weight percent actives based on a total weight of the surfactant component;

wherein at least two of the (1) alcohol ethoxy sulfate, the (2) alkoxylated alcohol, and the (3) linear alkylbenzene sulfonate are present in an amount of greater than zero; and D. water present in a total amount of at least about 60 weight percent based on a total weight of the detergent; and wherein the detergent composition has a turbidity of less than about 80 NTU measured at 25° C. when sodium chloride is utilized to the exclusion of potassium chloride, a turbidity of less than about 110 NTU measured at 25° C. when potassium chloride is utilized to the exclusion of sodium chloride, and a turbidity of less than about 100 NTU measured at 25° C. when both sodium and potassium chloride are utilized.

This disclosure also provides a detergent composition consisting essentially of:

A. a co-polymer of diallyldimethylammonium chloride and acrylic acid present in an amount of from about 0.2 to about 0.3 weight percent actives based on a total weight of the composition;

B. sodium chloride present in an amount of from about 1 to about 2 weight percent actives based on a total weight of the composition;

C. a surfactant component present in an amount of from about 12 to about 13 weight percent actives based on a total weight of the composition and comprising:

(1) sodium laureth sulfate ethoxylated with about 2 to about 4 moles of ethylene oxide and is present in an amount of from about 30 to about 33 weight percent actives based on a total weight of the surfactant component;

(2) a C12-C15 alcohol ethoxylate that is capped with about 7 moles of ethylene oxide and is present in an amount of from about 53 to about 55 weight percent actives based on a total weight of the surfactant component; and (3) a linear alkylbenzene sulfonate that has a linear alkyl chain that has from about 10 to about 13 carbon atoms and is present in an amount of from about 13 to about 15 weight percent actives based on a total weight of the surfactant component; and D. water present in a total amount of at least about 60 weight percent based on a total weight of the detergent; and wherein the detergent composition has a turbidity of less than about 72 NTU measured at 25° C.

The detergent composition exhibits superior and unexpected results. More specifically, it was discovered that improvements were surprisingly found when a total ionic strength of the detergent composition surpassed a critical concentration. This allowed for the co-polymer to be stabilized with a lower concentration of the three surfactants of the surfactant component. The linear alkylbenzene sulfonate did not negatively impact turbidity when in the detergent composition. However, the alcohol ethoxy sulfate did negatively affect turbidity. It was previously believed that both of these surfactants would affect turbidity. Therefore, the results are surprising, unexpected, and superior to what is known and shown in the art.

BRIEF DESCRIPTION OF THE DRAWINGS

The present disclosure will hereinafter be described in conjunction with the following FIGURES, wherein.

an alkoxylated alcohol, and (3) a linear alkylbenzene sulfonate, as set forth as follows:

(A) 0.6:0.4:0;
(B) 0.1:0.9:0;
(C) 0:0.9:0.1;
(D) 0:0.1:0.9;
(E) 0.1:0:0.9;
(F) 0.4:0:0.6; and
(G) 0.4:0.2:0.4;

wherein the corners represent 100 wt % actives of surfactant; and

Figure 1A:
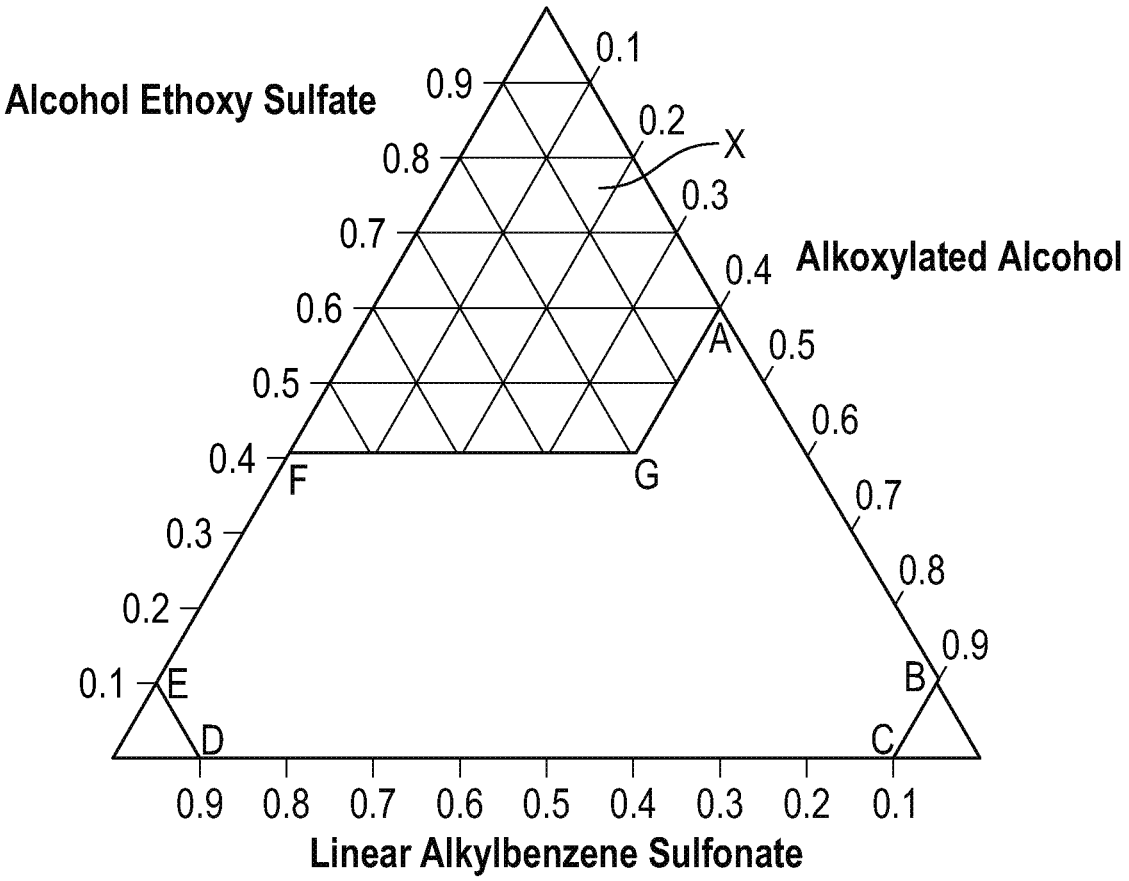
FIG. 1A is a ternary plot of weight ratios of actives of three surfactants of various embodiments of the instant disclosure showing a multi-sided region (X) that is defined by seven points of the weight ratio actives of (1) an alcohol ethoxy sulfate having a C8-C20 backbone that is ethoxylated with from about 1 to about 10 moles of ethylene oxide, (2)
Figure 1B:
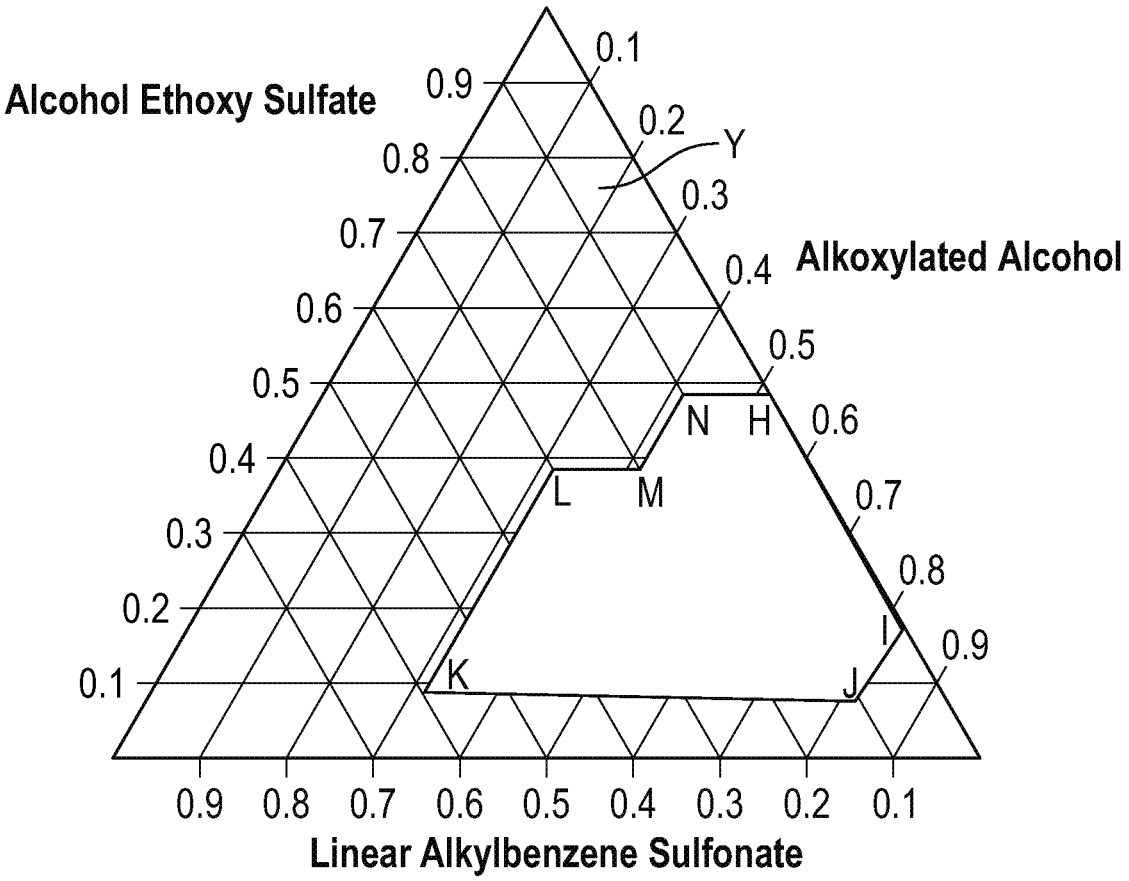

FIG. 1B is a ternary plot of weight ratios of actives of three surfactants of various embodiments of the instant disclosure showing a multi-sided region (Y) that is defined by seven points of the weight ratio actives of (1) an alcohol ethoxy sulfate having a C8-C20 backbone that is ethoxylated with from about 1 to about 10 moles of ethylene oxide, (2) an alkoxylated alcohol, and (3) a linear alkylbenzene sulfonate, as set forth as follows:

(H) 0.5:0.5:0;
(I) 0.2:0.8:0;
(J) 0:0.8:0.2;
(K) 0.1:0.3:0.6;
(L) 0.4:0.3:0.3;
(M) 0.4:0.4:0.2; and
(N) 0.5:0.4:0.1, wherein the corners represent 100 wt % actives of surfactant.

DETAILED DESCRIPTION OF THE DISCLOSURE

The following detailed description is merely exemplary in nature and is not intended to limit the disclosure. Furthermore, there is no intention to be bound by any theory presented in the preceding background or the following detailed description.

Embodiments of the present disclosure are generally directed to detergent compositions and methods for forming the same. For the sake of brevity, conventional techniques related to detergent compositions may not be described in detail herein. Moreover, the various tasks and process steps described herein may be incorporated into a more comprehensive procedure or process having additional steps or functionality not described in detail herein. In particular, various steps in the manufacture of detergent compositions are well-known and so, in the interest of brevity, many conventional steps will only be mentioned briefly herein or will be omitted entirely without providing the well-known process details.

In one aspect, the present disclosure provides a detergent composition with reduced turbidity. The detergent composition is typically used as a liquid detergent composition product but is not limited to such applications. The detergent composition may alternatively be used for laundry applications, dishwashing applications, industrial or residential surfactant and cleanser applications, etc.

In one embodiment, this disclosure provides a detergent composition comprising:

A. a co-polymer of diallyldimethylammonium chloride and acrylic acid present in an amount of from about 0.05 to about 1 weight percent actives based on a total weight of the composition;
B. sodium and/or potassium chloride present in an amount of greater than about 0.5 up to about 5 weight percent actives based on a total weight of the composition;
C. a surfactant component present in an amount of from about 8 to about 30 weight percent actives based on a total weight of the composition and comprising:
   (1) an alcohol ethoxy sulfate having a C8-C20 backbone that is ethoxylated with from about 1 to about 10 moles of ethylene oxide and present in an amount of from about 0 to about 60 weight percent actives based on a total weight of the surfactant component;
   (2) an alkoxylated alcohol present in an amount of from about 0 to about 90 weight percent actives based on a total weight of the surfactant component;
   (3) a linear alkylbenzene sulfonate present in an amount of from about 0 to about 90 weight percent actives based on a total weight of the surfactant component;

wherein at least two of the (1) alcohol ethoxy sulfate, the (2) alkoxylated alcohol, and the (3) linear alkylbenzene sulfonate are present in an amount of greater than zero; and D. water present in a total amount of at least about 60 weight percent based on a total weight of the detergent; and wherein the detergent composition has a turbidity of less than about 80 NTU measured at 25° C. when sodium chloride is utilized to the exclusion of potassium chloride, a turbidity of less than about 110 NTU measured at 25° C. when potassium chloride is utilized to the exclusion of sodium chloride, and a turbidity of less than about 100 NTU measured at 25° C. when both sodium and potassium chloride are utilized.

In another embodiment, this disclosure also provides a detergent composition consisting essentially of:

A. a co-polymer of diallyldimethylammonium chloride and acrylic acid present in an amount of from about 0.2 to about 0.3 weight percent actives based on a total weight of the composition;
B. sodium chloride present in an amount of from about 1 to about 2 weight percent actives based on a total weight of the composition;
C. a surfactant component present in an amount of from about 12 to about 13 weight percent actives based on a total weight of the composition and comprising:
   (1) sodium laureth sulfate ethoxylated with about 2 to about 4 moles of ethylene oxide and is present in an amount of from about 30 to about 33 weight percent actives based on a total weight of the surfactant component;
   (2) a C12-C15 alcohol ethoxylate that is capped with about 7 moles of ethylene oxide and is present in an amount of from about 53 to about 55 weight percent actives based on a total weight of the surfactant component; and
   (3) a linear alkylbenzene sulfonate that has a linear alkyl chain that has from about 10 to about 13 carbon atoms and is present in an amount of from about 13 to about 15 weight percent actives based on a total weight of the surfactant component; and
D. water present in a total amount of at least about 60 weight percent based on a total weight of the detergent; and wherein the detergent composition has a turbidity of less than about 72 NTU measured at 25° C.

Throughout this disclosure, the terminology percent "actives" is well recognized in the art and means the percent amount of active or actual compound or molecule present as compared to, for example, a total weight of a diluted solution of water and such a compound. Some compounds, such as water, are not described relative to a percent actives because it is well known to be approximately 100% actives of $H_2O$.

In another aspect, the present disclosure provides a method for reducing turbidity of a detergent composition. The method includes the step of providing a preliminary detergent composition that includes the surfactant component, water, and co-polymer described below. This preliminary detergent composition has a particular turbidity. The method also includes the step of adding sodium and/or potassium chloride thereto. This combination forms the detergent composition from the preliminary detergent composition and lowers the turbidity of the preliminary detergent composition to a second turbidity, as described below.

It was unexpectedly discovered that, as a result of incorporating the sodium and/or potassium chloride, the detergent composition shows a trend of reducing turbidity thereby indicating increased solution stability. More specifically, it was discovered that improvements were surprisingly found when a total ionic strength of the detergent composition surpassed a critical concentration. This allowed for the co-polymer to be stabilized with a lower concentration of the three surfactants of the surfactant component. The linear alkylbenzene sulfonate did not negatively impact turbidity when in the detergent composition. However, the alcohol ethoxy sulfate did negatively affect turbidity. It was previously believed that both of these surfactants would affect turbidity. Therefore, the results are surprising, unexpected, and superior to what is known and shown in the art.

Detergent Composition

This disclosure provides the detergent composition, first introduced above and hereinafter referred to as a composition. The composition may be, include, consist essentially of, or consist of, the cationic polymer, sodium and/or potassium chloride, the surfactant component, and water, as each is described below, e.g. in any one or more of the amounts described in greater detail below.

In one embodiment, the composition comprises the co-polymer of diallyldimethylammonium chloride and acrylic acid, the sodium and/or potassium chloride, the surfactant component, and the water.

In another embodiment, the composition consists essentially of the co-polymer of diallyldimethylammonium chloride and acrylic acid, the sodium and/or potassium chloride, the surfactant component, and the water.

In still another embodiment, the composition consists of the co-polymer of diallyldimethylammonium chloride and acrylic acid, the sodium and/or potassium chloride, the surfactant component, and the water.

In yet another embodiment, the composition comprises the co-polymer of diallyldimethylammonium chloride and acrylic acid, the sodium and/or potassium chloride, the surfactant component, the water, and one or more additional surfactants.

In another embodiment, the composition consists essentially of the co-polymer of diallyldimethylammonium chloride and acrylic acid, the sodium and/or potassium chloride, the surfactant component, the water, and one or more additional surfactants.

In another embodiment, the composition consists of the co-polymer of diallyldimethylammonium chloride and acrylic acid, the sodium and/or potassium chloride, the surfactant component, the water, and one or more additional surfactants.

In yet another embodiment, the composition comprises the co-polymer of diallyldimethylammonium chloride and acrylic acid, the sodium and/or potassium chloride, the surfactant component, the water, one or more additional surfactants, and one or more additives.

In another embodiment, the composition consists essentially of the co-polymer of diallyldimethylammonium chloride and acrylic acid, the sodium and/or potassium chloride, the surfactant component, the water, one or more additional surfactants, and one or more additives.

In another embodiment, the composition consists of the co-polymer of diallyldimethylammonium chloride and acrylic acid, the sodium and/or potassium chloride, the surfactant component, the water, one or more additional surfactants, and one or more additives.

In yet another embodiment, the composition comprises the co-polymer of diallyldimethylammonium chloride and acrylic acid, the sodium and/or potassium chloride, the surfactant component, the water, and one or more additives, and is free of one or more additional surfactants.

In another embodiment, the composition consists essentially of the co-polymer of diallyldimethylammonium chloride and acrylic acid, the sodium and/or potassium chloride, the surfactant component, the water, and one or more additives, and is free of one or more additional surfactants.

In another embodiment, the composition consists of the co-polymer of diallyldimethylammonium chloride and acrylic acid, the sodium and/or potassium chloride, the surfactant component, the water, and one or more additives, and is free of one or more additional surfactants.

In various embodiments throughout this disclosure, the terminology "consists essentially of" or "consisting essentially of" describes that the composition may be free of, or include less than 1, 0.5, 0.1, 0.05, or 0.01, weight percent of, any one or more of the optional components or additives described above or below, one or more salts that are not sodium and/or potassium chloride, any co-polymer that is not the co-polymer of this disclosure, any one or more surfactants that are not those of this disclosure, any non-aqueous solvents, aqueous solvents that are not water, etc., as understood by those of skill in the art.

Co-Polymer of Diallyldimethylammonium Chloride and Acrylic Acid:

The composition also includes the copolymer of diallyldimethylammonium chloride (DADMAC) and acrylic acid. This copolymer is not particularly limited and may be any known in the art. The copolymer is present in an amount of from about 0.05 to about 1 weight percent actives based on a total weight of the composition. In other embodiments, the copolymer is present in an amount of from about 0.1 to about 0.95, about 0.15 to about 0.9, about 0.2 to about 0.85, about 0.25 to about 0.8, about 0.3 to about 0.75, about 0.35 to about 0.7, about 0.4 to about 0.65, about 0.45 to about 0.6, or about 0.5 to about 0.55, weight percent actives based on a total weight of the composition. In other embodiments, the copolymer is present in an amount of about 0.05, 0.1, 0.15, 0.2, 0.25, 0.3, 0.35, 0.4, 0.45, 0.5, 0.66, 0.6, 0.65, 0.7, 0.75, 0.8, 0.85, 0.9, 0.95 or 1, weight percent actives based on a total weight of the composition. In various non-limiting embodiments, all values, both whole and fractional, between and including all of the above, are hereby expressly contemplated for use herein.

Sodium and/or Potassium Chloride:

The composition also includes sodium and/or potassium chloride. For example, the composition may include sodium chloride to the exclusion of potassium chloride. Alternatively, the composition may include potassium chloride to the exclusion of sodium chloride. In another embodiment, the composition includes both sodium chloride and potassium chloride. The sodium and/or potassium chloride is present in an amount of greater than about 0.5 weight percent actives based on a total weight of the composition. In various embodiments this weight is greater than about 0.5 and up to about 10, greater than about 0.5 and up to about 7.5, greater than about 0.5 and up to about 5, greater than about 0.5 and up to about 4.5, about 1 to about 4, about 1.5 to about 3.5, about 2 to about 3, about 2.5 to about 3, greater than about 0.5 and up to about 3, greater than about 0.5 and up to about 2.5, greater than about 0.5 and up to about 2, greater than about 0.5 and up to about 1.5, greater than about 0.5 and up to about 1, greater than about 0.5 and up to about 0.75, about 0.75 to about 2, about 0.75 to about 1.75, about 0.75 to about 1.5, about 0.75 to about 1.25, about 0.75 to about 1, about 1 to about 2, about 1 to about 1.75, about 1 to about 1.5, about 1 to about 1.25, about 1.25 to about 2, about 1.25 to about 1.75, about 1.25 to about 1.5, about 1.5 to about 2, about 1.5 to about 1.75, about 1.75 to about 2, weight percent actives based on a total weight of the composition. In other embodiments, this amount is about 0.55, 0.6, 0.65, 0.7, 0.75, 0.8, 0.85, 0.9, 0.95, 1, 1.05, 1.1, 1.15, 1.2, 1.25, 1.3, 1.35, 1.4, 1.45, 1.5, 1.55, 1.6, 1.65, 1.7, 1.75, 1.8, 1.85, 1.9, 1.95, or 2, weight percent actives based on a total weight of the composition. In various non-limiting embodiments, all values, both whole and fractional, between and including all of the above, are hereby expressly contemplated for use herein.

In various embodiments, the composition is free of, or includes less than 5, 4, 3, 2, 1, 0.5, 0.1, or 0.05, weight percent actives of other salts such as organic and inorganic salts, based on a total weight of the composition. For example, such salts include sodium and/or potassium citrate, Group I and II metal organic salts, transition metal organic salts, etc. However, it is contemplated that citrates may be utilized as formed from citric acid used in the composition. The same may be true for other organic salts formed from organic acids used in the composition. Typically, though, citrates or other organic salts are not specifically added to control turbidity.

Turbidity:

Typically, the composition has a turbidity of less than about 80 NTU measured at 25° C. when sodium chloride is utilized, e.g. to the exclusion of potassium chloride. For example, in various embodiments, the turbidity may be less than about 75, 70, 65, 60, 55, 50, 45, 40, 35, 30, 25, 20, etc., NTU measured at 25° C. In other embodiments, the composition has a turbidity of less than about 110 NTU measured at 25° C. when potassium chloride is utilized, e.g. to the exclusion of sodium chloride. For example, in various embodiments, the turbidity may be less than about 110, 105, 100, 95, 90, 85, 80, 75, 70, 65, 60, 55, 50, 45, 40, 35, 30, 25, 20, etc., NTU measured at 25° C. In still other embodiments, the composition has a turbidity of less than about 100 NTU measured at 25° C., e.g. when both sodium and potassium chloride are utilized. For example, in various embodiments, the turbidity may be less than about 100, 95, 90, 85, 80, 75, 70, 65, 60, 55, 50, 45, 40, 35, 30, 25, 20, etc., NTU measured at 25° C. Typically turbidity is measured using a Hatch 2100N turbidity meter at about 25° C. in a glass vial. Without intending to be bound by any particular theory, it is believed that similar solutions without the copolymer are transparent. As such, it is the copolymer that typically leads to turbidity issues wherein in the technology of the instant disclosure minimizes this turbidity. In various non-limiting embodiments, all values, both whole and fractional, between and including all of the above, are hereby expressly contemplated for use herein.

Surfactant Component

As first introduced above, the composition includes the surfactant component. The surfactant component includes, is, consists essentially of, or consists of, three surfactants (1), (2) and (3), i.e., (1) an alcohol ethoxy sulfate having a C8-C20 backbone that is ethoxylated with from about 1 to about 10 moles of ethylene oxide, (2) an alkoxylated alcohol, and (3) a linear alkylbenzene sulfonate. In various non-limiting embodiments, all values, both whole and fractional, between and including all of the above, are hereby expressly contemplated for use herein.

In one embodiment, the surfactant component includes (1) an alcohol ethoxy sulfate having a C8-C20 backbone that is ethoxylated with from about 1 to about 10 moles of ethylene oxide, (2) an alkoxylated alcohol, and (3) a linear alkylbenzene sulfonate. In various non-limiting embodiments, all values, both whole and fractional, between and including all of the above, are hereby expressly contemplated for use herein.

In another embodiment, the surfactant component consists essentially of (1) an alcohol ethoxy sulfate having a C8-C20 backbone that is ethoxylated with from about 1 to about 10 moles of ethylene oxide, (2) an alkoxylated alcohol, and (3) a linear alkylbenzene sulfonate. In various non-limiting embodiments, all values, both whole and fractional, between and including all of the above, are hereby expressly contemplated for use herein.

In a further embodiment, the surfactant component consists of (1) an alcohol ethoxy sulfate having a C8-C20 backbone that is ethoxylated with from about 1 to about 10 moles of ethylene oxide, (2) an alkoxylated alcohol, and (3) a linear alkylbenzene sulfonate. In various non-limiting embodiments, all values, both whole and fractional, between and including all of the above, are hereby expressly contemplated for use herein.

In various embodiments, the (1) alcohol ethoxy sulfate is present in an amount of from about 0 to about 60 weight percent actives based on a total weight of the surfactant component. The (2) alkoxylated alcohol is present in an amount of from about 0 to about 90 weight percent actives based on a total weight of the surfactant component. The (3) linear alkylbenzene is sulfonate present in an amount of from about 0 to about 90 weight percent actives based on a total weight of the surfactant component. In the above, at least two of the (1) alcohol ethoxy sulfate, the (2) alkoxylated alcohol, and the (3) linear alkylbenzene sulfonate are each independently present in an amount of greater than zero. Said differently, at least two of the surfactants (1) alcohol ethoxy sulfate, (2) alkoxylated alcohol, and (3) linear alkylbenzene sulfonate must be present. This means that two of the surfactants cannot be present in an amount of zero. For example, the surfactant component includes:

(1) the alcohol ethoxy sulfate, (2) the alkoxylated alcohol, and (3) the linear alkylbenzene sulfonate; or (1) the alcohol ethoxy sulfate and (2) the alkoxylated alcohol without (3) the linear alkylbenzene sulfonate; or (1) the alcohol ethoxy sulfate and (3) the linear alkylbenzene sulfonate without (2) the alkoxylated alcohol; or (2) the alkoxylated alcohol and (3) the linear alkylbenzene sulfonate, without (1) the alcohol ethoxy sulfate.

In various non-limiting embodiments, all values, both whole and fractional, between and including all of the above, are hereby expressly contemplated for use herein.

In other embodiments, the surfactant (1), which is the alcohol ethoxy sulfate, may be present in an amount of about 0, 5, 10, 15, 20, 25, 30, 35, 40, 45, 50, 55, or 60, weight percent actives based on a total weight of the surfactant component. In various embodiments, this surfactant is present in an amount of from about 25 to about 40, about 30 to about 35, or about 30, 31, 32, 33, 34, 35, 36, 37, 38, 39, or 40, weight percent actives based on a total weight of the surfactant component. In other embodiments, this surfactant is present in an amount of from about 0 to about 60, about 5 to about 55, about 10 to about 50, about 15 to about 45, about 20 to about 40, about 25 to about 35, or about 25 to about 30, weight percent actives based on a total weight of the surfactant component. In various non-limiting embodiments, all values, both whole and fractional, between and including all of the above, are hereby expressly contemplated for use herein.

Moreover, surfactant (2), which is the alkoxylated alcohol may be present in an amount of about 0, 5, 10, 15, 20, 25, 30, 35, 40, 45, 50, 55, 60, 65, 70, 75, 80, 85, or 90, weight percent actives based on a total weight of the surfactant component. In various embodiments, this surfactant is present in an amount of from about 45 to about 60, about 50 to about 55, or about 50, 51, 52, 53, 54, 55, 56, 57, 58, 59, or 60, weight percent actives based on a total weight of the surfactant component. In other embodiments, this surfactant is present in an amount of from about 0 to about 90, about 5 to about 85, about 10 to about 80, about 15 to about 75, about 20 to about 70, about 25 to about 65, about 30 to about 60, about 35 to about 55, about 40 to about 50, or about 45 to about 50, weight percent actives based on a total weight of the surfactant component. In various non-limiting embodiments, all values, both whole and fractional, between and including all of the above, are hereby expressly contemplated for use herein.

Furthermore, surfactant (3), which is the linear alkylbenzene, may be present in an amount of about 0, 5, 10, 15, 20, 25, 30, 35, 40, 45, 50, 55, 60, 65, 70, 75, 80, 85, or 90, weight percent actives based on a total weight of the surfactant component. In other embodiments, this surfactant is present in an amount of from about 0 to about 90, about 5 to about 85, about 10 to about 80, about 15 to about 75, about 20 to about 70, about 25 to about 65, about 30 to about 60, about 35 to about 55, about 40 to about 50, or about 45 to about 50, weight percent actives based on a total weight of the surfactant component. In various non-limiting embodiments, all values, both whole and fractional, between and including all of the above, are hereby expressly contemplated for use herein.

In the above, at least two of the (1) alcohol ethoxy sulfate, the (2) alkoxylated alcohol, and the (3) linear alkylbenzene sulfonate are each independently present in an amount of greater than zero. In various non-limiting embodiments, all values, both whole and fractional, between and including all of the above, are hereby expressly contemplated for use herein.

The (1) alcohol ethoxy sulfate, the (2) alkoxylated alcohol, and the (3) linear alkylbenzene sulfonate may be present in a weight ratio of about (0 to 60):about (0 to 90):about (0 to 90). In other embodiments, the surfactant (1), which is the alcohol ethoxy sulfate, may be present in an amount of the aforementioned ratio of about 0, 0.5, 0.1, 0.15, 0.2, 0.25, 0.3, 0.35, 0.4, 0.45, 0.5, 0.55, or 0.6. Moreover, surfactant (2), which is the alkoxylated alcohol, may be present in an amount of the aforementioned ratio of about 0, 0.5, 0.1, 0.15, 0.2, 0.25, 0.3, 0.35, 0.4, 0.45, 0.5, 0.55, 0.6, 0.65, 0.7, 0.75, 0.8, 0.85, or 0.9. Furthermore, surfactant (3), which is the linear alkylbenzene, may be present in an amount of the aforementioned ratio of about 0, 0.5, 0.1, 0.15, 0.2, 0.25, 0.3, 0.35, 0.4, 0.45, 0.5, 0.55, 0.6, 0.65, 0.7, 0.75, 0.8, 0.85, or 0.9. In various non-limiting embodiments, all values, both whole and fractional, between and including all of the above, are hereby expressly contemplated for use herein.

In one embodiment, as shown in FIG. 1A, the weight ratio of actives of the (1) alcohol ethoxy sulfate:the (2) alkoxylated alcohol:the (3) linear alkylbenzene sulfonate falls within a multi-sided region (X) of a ternary plot, wherein the multi-sided region (X) is defined by seven points approximately as follows:

(A) 0.6:0.4:0;
(B) 0.1:0.9:0;
(C) 0:0.9:0.1;
(D) 0:0.1:0.9;
(E) 0.1:0:0.9;
(F) 0.4:0:0.6; and
(G) 0.4:0.2:0.4.

In various embodiments, each of these values may independently vary by about 1, 5, 10, 15, or 20 percent. In various non-limiting embodiments, all values, both whole and fractional, between and including all of the above, are hereby expressly contemplated for use herein.

In another embodiment, as shown in FIG. 1B, the weight ratio of actives of the (1) alcohol ethoxy sulfate:the (2) alkoxylated alcohol:the (3) linear alkylbenzene sulfonate falls within a multi-sided region (Y) of a ternary plot, wherein the multi-sided region (Y) is defined by seven points approximately as follows:

(H) 0.5:0.5:0;
(I) 0.2:0.8:0;
(J) 0:0.8:0.2;
(K) 0.1:0.3:0.6;
(L) 0.4:0.3:0.3;
(M) 0.4:0.4:0.2; and
(N) 0.5:0.4:0.1.

In various embodiments, each of these values may independently vary by about 1, 5, 10, 15, or 20 percent. In various non-limiting embodiments, all values, both whole and fractional, between and including all of the above, are hereby expressly contemplated for use herein.

In one embodiment, wherein the (1) is the alcohol ethoxy sulfate, the (2) is the alkoxylated alcohol, and (3) is the linear alkylbenzene sulfonate, the weight ratio of actives of (1), (2), and (3) are about 0.6:0.4:0. In another embodiment, the weight ratio of actives of (1), (2), and (3) are about 0.1:0.9:0. In another embodiment, the weight ratio of actives of (1), (2), and (3) are about 0:0.9:0.1. In another embodiment, the weight ratio of actives of (1), (2), and (3) are about 0:0.1:0.9. In another embodiment, the weight ratio of actives of (1), (2), and (3) are about 0.1:0:0.9. In another embodiment, the weight ratio of actives of (1), (2), and (3) are about 0.4:0:0.6. In another embodiment, the weight ratio of actives of (1), (2), and (3) are about 0.4:0.2:0.4. In another embodiment, the weight ratio of actives of (1), (2), and (3) are about 0.5:0.5:0. In another embodiment, the weight ratio of actives of (1), (2), and (3) are about 0.2:0.8:0. In another embodiment, the weight ratio of actives of (1), (2), and (3) are about 0:0.8:0.2. In another embodiment, the weight ratio of actives of (1), (2), and (3) are about 0.1:0.3:0.6. In another embodiment, the weight ratio of actives of (1), (2), and (3) are about 0.4:0.3:0.3. In another embodiment, the weight ratio of actives of (1), (2), and (3) are about 0.4:0.4:0.2. In another embodiment, the weight ratio of actives of (1), (2), and (3) are about 0.5:0.4:0.1. In various embodiments, each of these values may independently vary by about 1, 5, 10, 15, or 20 percent. Each of these points is also shown in FIG. 1A or 1B. It is contemplated that the weight ratios of the active of (1), (2), and (3) may fall anywhere within the ternary plot shown in FIG. 1A or 1B or anywhere within the multisided-sided FIGURES of FIG. 1A or 1B. In various non-limiting embodiments, all values, both whole and fractional, between and including all of the above, are hereby expressly contemplated for use herein.

The amount of the surfactant component itself in the composition is not particularly limited. In various embodiments, the surfactant component can be present in the composition in an amount of from about 5 to about 30, about 8 to about 30, about 10 to about 25, about 15 to about 20, about 10 to about 15, about 11 to about 14, about 12 to about 13, or about 5, 6, 7, 8, 9, 10, 11, 12, 13, 14, 15, 16, 17, 18, 19, 20, 21, 22, 23, 24, 25, 26, 27, 28, 29, or 30, weight percent actives based on a total weight of the composition. In various non-limiting embodiments, all values, both whole and fractional, between and including all of the above, are hereby expressly contemplated for use herein.

Alcohol Ether Sulfate

The surfactant component includes the (1) alcohol ethoxy sulfate, which may be described as an anionic surfactant. The alcohol ethoxy sulfate has a $C_8$-$C_{20}$ backbone that is ethoxylated with from about 1 to about 10 moles of ethylene oxide. Alternatively, the alcohol ethoxy sulfate may be described as having a $C_8$-$C_{20}$ backbone and about 1 to 10 moles of ethylene oxide units bonded thereto. The backbone may have any number of carbon atoms from 8 to 20, e.g. 10 to 18, 12 to 16, 12 to 14, 14 to 16, or 8, 9, 10, 11, 12, 13, 14, 15, 16, 17, 18, 19, or 20, carbon atoms. Various mixtures of alcohol ethoxy sulfates may also be used wherein different length backbones are utilized. The backbone is ethoxylated with from about 1 to about 10, about 2 to about 9, about 3 to about 8, about 4 to about 7, about 5 to about 6, or 1, 2, 3, 4, 5, 6, 7, 8, 9, or 10, moles of ethylene oxide. In various non-limiting embodiments, all values, both whole and fractional, between and including all of the above, are hereby expressly contemplated for use herein.

In various embodiments, the alcohol ethoxy sulfate is further defined as sodium laureth sulfate (SLES) having the formula: $CH_3(CH_2)_{10}CH_2(OCH_2CH_2)_nOSO_3Na$ wherein n is from about 1 to about 10. In another embodiment, the alcohol ethoxy sulfate is sodium laureth sulfate ethoxylated with about 2 to about 4 moles of ethylene oxide. In various non-limiting embodiments, all values, both whole and fractional, between and including all of the above, are hereby expressly contemplated for use herein.

Alkoxylated Alcohol:

The surfactant component also includes the (2) alkoxylated alcohol. The alkoxylated alcohol may be a $C_8$-$C_{20}$ alcohol that is capped with (or comprises) approximately 2 to 12 moles of an alkylene oxide. In other embodiments, the alkoxylated alcohol may be an alcohol alkoxylate that has from 8 to 20, 10 to 18, 12 to 16, or 12 to 14, carbon atoms and is an ethoxylate, propoxylate, or butoxylate and is capped with an alkylene oxide, e.g. ethylene oxide, propylene oxide, or butylene oxide. The alcohol alkoxylate may be capped with varying numbers of moles of the alkylene oxide, e.g. about 2 to about 12, about 3 to about 11, about 4 to about 10, about 5 to about 9, about 6 to about 8, or about 7 to about 8, moles. In various non-limiting embodiments, all values, both whole and fractional, between and including all of the above, are hereby expressly contemplated for use herein.

Linear Alkylbenzene Sulfonate

The surfactant component also includes the (3) linear alkylbenzene sulfonate (LAS). The linear alkylbenzene sulfonate may have a linear alkyl chain that has, e.g. 10 to 13 carbon atoms. These carbon atoms are present in approximately the following mole ratios C10:C11:C12:C13 is about 13:30:33:24 having an average carbon number of about 11.6 and a content of the most hydrophobic 2-phenyl isomers of about 18-29 wt %. The linear alkylbenzene sulfonate may be any known in the art. In various non-limiting embodiments, all values, both whole and fractional, between and including all of the above, are hereby expressly contemplated for use herein.

In one embodiment, the alcohol ethoxy sulfate is sodium laureth sulfate ethoxylated with about 2 to about 4 moles of ethylene oxide, the linear alkyl benzenesulfonate has a linear alkyl chain that has from about 10 to about 13 carbon atoms, and the alkoxylated alcohol is an ethoxylated alcohol comprising a $C_8$-$C_{20}$ backbone that is ethoxylated with from about 2 to about 12 moles of ethylene oxide.

In another embodiment, the (1) alcohol ethoxy sulfate is sodium laureth sulfate ethoxylated with about 2 to about 4 moles of ethylene oxide, the (2) alkoxylated alcohol is a C12-C15 alcohol ethoxylate that is capped with approximately 7 moles of ethylene oxide; and the (3) linear alkyl benzenesulfonate is optionally 2-Phenyl Sulfonic Acid. In a related embodiment, the weight ratio of actives of these particular (1):(2):(3) falls within a multi-sided region (X) of a ternary plot, e.g. as set forth in FIG. 1A, wherein the multi-sided region (X) is defined by seven points approximately as follows:

(A) 0.6:0.4:0;
(B) 0.1:0.9:0;
(C) 0:0.9:0.1;
(D) 0:0.1:0.9;
(E) 0.1:0:0.9;
(F) 0.4:0:0.6; and
(G) 0.4:0.2:0.4.

In various non-limiting embodiments, all values, both whole and fractional, between and including all of the above within the three-sided region, are hereby expressly contemplated for use herein.

In another embodiment, the (1) alcohol ethoxy sulfate is sodium laureth sulfate ethoxylated with about 2 to about 4 moles of ethylene oxide, the (2) alkoxylated alcohol is a C12-C15 alcohol ethoxylate that is capped with approximately 7 moles of ethylene oxide; and the (3) linear alkyl benzenesulfonate is optionally 2-Phenyl Sulfonic Acid wherein the weight ratio of actives of these particular (1):(2):(3) falls within a multi-sided region (Y) of a ternary plot, e.g. as set forth in FIG. 1B, wherein the multi-sided region (Y) is defined by seven points approximately as follows:

(H) 0.5:0.5:0;
(I) 0.2:0.8:0;
(J) 0:0.8:0.2;
(K) 0.1:0.3:0.6;
(L) 0.4:0.3:0.3;
(M) 0.4:0.4:0.2; and
(N) 0.5:0.4:0.1.

In various non-limiting embodiments, all values, both whole and fractional, between and including all of the above within the three-sided region, are hereby expressly contemplated for use herein.

Additional Surfactants

In other embodiments, one or more additional surfactants may be utilized and may be or include cationic, anionic, non-ionic, and/or zwitterionic surfactants, and/or combinations thereof. Alternatively, the composition may be free of one or more of such additional surfactants. Additional anionic surfactants may include soaps which contain sulfate or sulfonate groups, including those with alkali metal ions as cations, can be used. Usable soaps include alkali metal salts of saturated or unsaturated fatty acids with 12 to 18 carbon (C) atoms. Such fatty acids may also be used in incompletely neutralized form. Usable ionic surfactants of the sulfate type include the salts of sulfuric acid semi esters of fatty alcohols with 12 to 18 C atoms. Usable ionic surfactants of the sulfonate type include alkane sulfonates with 12 to 18 C atoms and olefin sulfonates with 12 to 18 C atoms, such as those that arise from the reaction of corresponding monoolefins with sulfur trioxide, alpha-sulfofatty acid esters such as those that arise from the sulfonation of fatty acid methyl or ethyl esters. In various non-limiting embodiments, all values, both whole and fractional, between and including all of the above, are hereby expressly contemplated for use herein.

Other suitable examples of additional nonionic surfactants include alkyl glycosides and ethoxylation and/or propoxylation products of alkyl glycosides or linear or branched alcohols in each case having 12 to 18 carbon atoms in the alkyl moiety and 3 to 20, or 4 to 10, alkyl ether groups. Corresponding ethoxylation and/or propoxylation products of N-alkylamines, vicinal diols, and fatty acid amides, which correspond to the alkyl moiety in the stated long-chain alcohol derivatives, may furthermore be used. Alkylphenols having 5 to 12 carbon atoms may also be used in the alkyl moiety of the above described long-chain alcohol derivatives. In various non-limiting embodiments, all values, both whole and fractional, between and including all of the above, are hereby expressly contemplated for use herein.

In other embodiments, the additional surfactant is chosen from nonionic and ionic surfactants, such as alkoxylates, polyglycerols, glycol ethers, glycols, polyethylene glycols, polypropylene glycols, polybutylene glycols, glycerol ester ethoxylates, polysorbates, alkyl ether sulfates, alkyl- and/or arylsulfonates, alkyl sulfates, ester sulfonates (sulfo-fatty acid esters), ligninsulfonates, fatty acid cyanamides, anionic sulfosuccinic acid surfactants, fatty acid isethionates, acylaminoalkane-sulfonates (fatty acid taurides), fatty acid sarcosinates, ether carboxylic acids and alkyl(ether)phosphates. In such embodiments, suitable nonionic surfactants include $C_2$-$C_6$-alkylene glycols and poly-$C_2$-$C_3$-alkylene glycol ethers, optionally, etherified on one side with a $C_1$-$C_6$-alkanol and having, on average, 1 to 9 identical or different, typically identical, alkylene glycol groups per molecule, and also alcohols and fatty alcohol polyglycol ethers, typically propylene glycol, dipropylene glycol, trimethylolpropane, and fatty alcohols with low degrees of ethoxylation having 6 to 22, typically 8 to 18, more typically 8 to 12, and even more typically 8 to 11, carbon atoms. Moreover, suitable ionic surfactants include alkyl ether sulfates, sulfosuccinic acid surfactants, polyacrylates and phosphonic acids, typically lauryl sulfate, lauryl ether sulfate, sodium sulfosuccinic acid diisooctyl ester, 1-hydroxyethane-1,1-diphosphonic acid, and diacetyltartaric esters. In various non-limiting embodiments, all values, both whole and fractional, between and including all of the above, are hereby expressly contemplated for use herein.

The one or more additional surfactants may be part of the surfactant component, as described above, or may be independent from the surfactant component. In various embodiments, the one or more additional surfactants is or includes an additional anionic surfactant and/or a non-ionic surfactant. However, other surfactants such as cationic and/or zwitterionic (amphoteric) surfactants may also be utilized or may be excluded from the composition.

Water:

The detergent composition also includes water. Water is present in the composition in a total amount of at least about 60 weight percent based on a total weight of the composition. In various embodiments, the water is present in a total amount of from about 60 to about 93, about 60 to about 90, about 65 to about 85, about 70 to about 80, about 75 to about 80, weight percent based on a total weight of the composition. Typically, the terminology "total amount" refers to a total amount of water present in the composition from all components, i.e., not simply water added independently from, for example, the surfactant component and/or the tertiary amine. In various non-limiting embodiments, all values, both whole and fractional, between and including all of the above, are hereby expressly contemplated for use herein.

An independent source of water, such as DI water, may be used to dilute the composition. This water may be independent from any water present in the composition as originating from one or more components. In other words, the composition includes water originating from the components themselves. However, to further dilute the composition, the independent water source may be used.

Non-Aqueous Solvent

In some embodiments, the composition may include, or may be free of, a non-aqueous solvent. In various embodiments, the non-aqueous solvent is present in an amount of from about 1 to about 30, about 3 to about 30, about 5 to about 30, about 10 to about 25, or about 15 to about 20, weight percent based on a total weight of the composition. In various non-limiting embodiments, all values, both whole and fractional, between and including all of the above, are hereby expressly contemplated for use herein.

The non-aqueous solvent is not particularly limited and may be any known in the art. In various embodiments, the non-aqueous solvent is chosen from glycerol (glycerin), propylene glycol, ethylene glycol, ethanol, and 4C+ compounds. The term "4C+ compound" refers to one or more of: polypropylene glycol; polyethylene glycol esters such as polyethylene glycol stearate, propylene glycol laurate, and/or propylene glycol palmitate; methyl ester ethoxylate; diethylene glycol; dipropylene glycol; tetramethylene glycol; butylene glycol; pentanediol; hexylene glycol; heptylene glycol; octylene glycol; 2-methyl, 1,3 propanediol; triethylene glycol; polypropylene glycol; glycol ethers, such as ethylene glycol monobutyl ether, diethylene glycol monobutyl ether, triethylene glycol monobutyl ether, ethylene glycol monopropyl ether, diethylene glycol monoethyl ether, triethylene glycol monoethyl ether, diethylene glycol monomethyl ether, and triethylene glycol monomethyl ether; tris (2-hydroxyethyl)methyl ammonium methylsulfate; ethylene oxide/propylene oxide copolymers with a number average molecular weight of 3,500 Daltons or less; and ethoxylated fatty acids. In other embodiments, the non-aqueous solvent is a relatively low molecular weight polyethylene glycol (PEG) having a weight average molecular weight of less than about 600 Da, e.g. about 400, such as those having a weight average molecular weight of from about 380 to about 420, Da. In other embodiments, PEG 200, PEG 250, PEG 300, PEG 350, PEG 400, PEG 450, PEG 500, PEG 550, and/or PEG 600 (wherein the numerals represent the approximate weight average molecular weight in Daltons) may be used. Other suitable non-aqueous solvents include ethylene oxide/propylene oxide block copolymers. In various non-limiting embodiments, all values, both whole and fractional, between and including all of the above, are hereby expressly contemplated for use herein.

In other embodiments, the composition is free of the non-aqueous solvent.

Additives:

The composition may include one or more of the following additives or may be free of one or more of the following additives. For example, the composition may include one or more foam inhibitors (e.g. defoaming agents). Suitable foam inhibitors include, but are not limited to, fatty acids such as coconut fatty acids. The composition may include the foam inhibitor at an amount of from about 0 to about 10 weight percent, based on the total weight of the composition. In various non-limiting embodiments, all values, both whole and fractional, between and including all of the above, are hereby expressly contemplated for use herein.

Bittering agents may optionally be added to hinder accidental ingestion of the composition. Bittering agents are compositions that taste bad, so children or others are discouraged from accidental ingestion. Exemplary bittering agents include denatonium benzoate, aloin, and others. Bittering agents may be present in the composition at an amount of from about 0 to about 1 weight percent, or an amount of from about 0 to about 0.5 weight percent, or an amount of from about 0 to about 0.1 weight percent in various embodiments, based on the total weight of the composition. In various non-limiting embodiments, all values, both whole and fractional, between and including all of the above, are hereby expressly contemplated for use herein.

In other embodiments, additives may be or include neutralizers/pH adjustors just as monoethanolamine and the like, enzymes, optical brighteners, chelators, and combinations thereof. These additives may be chosen from any known in the art.

The additive may include, or be free of, a cationic polymer (apart from the co-polymer of this disclosure) including, but not limited to, a copolymer of ((2-methacryloyloxy)ethyl)-trimethyl ammonium chloride, cationic cellulosic polymers, and combinations thereof.

It is further contemplated that the composition can include non-ionic and/or anionic soil release polymer, which may be any known in the art.

In one embodiment, the composition is free of, or includes less than 5, 4, 3, 2, 1, 0.5, or 0.1, weight percent of, a solvent other than water, e.g. any organic solvent, non-polar solvent, polar aprotic solvent, polar protic solvent, etc. and combinations thereof. In another embodiment, the composition is free of, or includes less than 5, 4, 3, 2, 1, 0.5, or 0.1, weight percent of, propylene glycol and/or glycerine. In various non-limiting embodiments, all values, both whole and fractional, between and including all of the above, are hereby expressly contemplated for use herein.

Weight Percents/Ratios of Various Components:

The aforementioned components are generally present in amounts within the weight ranges set forth above. However, in additional embodiments, these weight ranges may be narrower and/or specific weight ratios may be utilized. These weight ranges and/or ratios may be representative of embodiments that produce special, superior, and unexpected results, such as those demonstrated in the Examples. Relative to all of the paragraphs set forth immediately below, in various non-limiting embodiments, all values, both whole and fractional, between and including all of the above, are hereby expressly contemplated for use herein.

In various embodiments, predictive expressions, as set forth below, can be used to predict turbidity. For example, in one embodiment, the following predictive expression can be used:

> Turbidity=430 times (% surfactant of LAS of total surfactant)+−171.78 times (% surfactant of AES)+231.84 times (% surfactant of NI) with the total active surfactant approximately 12.55% and the active co-polymer 0.35% and no salt added, wherein LAS is linear alkylbenzene sulfonate, NI is the C12-C15 the alcohol ethoxylate, and AES is the alcohol ethoxy sulfate.

ADDITIONAL EMBODIMENTS

In one additional embodiment, the sodium and/or potassium chloride is present in an amount of from about 1 to about 2 percent actives based on a total weight of the composition; (1) the alcohol ethoxy sulfate is sodium laureth sulfate ethoxylated with about 2 to about 4 moles of ethylene oxide; (2) the alkoxylated alcohol is a C12-C15 alcohol ethoxylate that is capped with about 7 moles of ethylene oxide; and (3) the linear alkylbenzene sulfonate has a linear alkyl chain that has from about 10 to about 13 carbon atoms. In various non-limiting embodiments, all values, both whole and fractional, between and including all of the above, are hereby expressly contemplated for use herein.

In another embodiment, (1) is present in an amount of from about 0 to about 50 weight percent actives based on a total weight of the surfactant component, (2) is present in an amount of from about 30 to about 80 weight percent actives based on a total weight of the surfactant component, and (3) is present in an amount of from about 0 to about 60 weight percent actives based on a total weight of the surfactant component. In various non-limiting embodiments, all values, both whole and fractional, between and including all of the above, are hereby expressly contemplated for use herein.

In another embodiment, the surfactant component is present in an amount of from about 12 to about 13 weight percent actives based on a total weight of the composition and comprises: (1) sodium laureth sulfate ethoxylated with about 2 to about 4 moles of ethylene oxide and is present in an amount of from about 30 to about 33 weight percent actives based on a total weight of the surfactant component; (2) a C12-C15 alcohol ethoxylate that is capped with about 7 moles of ethylene oxide and is present in an amount of from about 53 to about 55 weight percent actives based on a total weight of the surfactant component; and (3) a linear alkylbenzene sulfonate that has a linear alkyl chain that has from about 10 to about 13 carbon atoms and is present in an amount of from about 13 to about 15 weight percent actives based on a total weight of the surfactant component. In various non-limiting embodiments, all values, both whole and fractional, between and including all of the above, are hereby expressly contemplated for use herein.

In still other embodiments, the composition may be, include, consist essentially of, or consist of, any combination of the following:

| Material Description | Activity (%) | Approximate Ranges w/w (%) |
|---|---|---|
| Water | 100.00 | 30 to 70 |
| Citric Acid 50% solution | 50.00 | 3 to 12 |
| Triethanolamine | 85.00 | 0.5 to 2 |
| Surfactant (2) e.g. Alcohol Ethoxylate 25-7 | 100.00 | 5 to 11.3 |
| Surfactant (3) e.g. LAS Sulfonic acid | 96.00 | 1.2 to 11.5 |
| Coco Fatty Acid | 100.00 | 0.25 to 1.5 |
| Sodium Hydroxide | 50.00 | Adjust to pH 7.2 to 8.2 |
| Surfactant (1) e.g. Steol 25-3S/60 (AES) | 60.00 | 2 to 8.5 |
| Performance Polymer | 80.00 | 0 to 4 |
| Optical Brightener | 100.00 | 0 to 0.30 |
| Chelator | 34.00 | 0 to 1.5 |
| Preservative | 8.60 | 0.02 to 0.15 |
| DADMAC-Acrylic Acid Copolymer | 42.50 | 0.1 to 0.7 |
| Water | 100.00 | QS to 90 |
| | --Total-- | ~100 |

In various non-limiting embodiments, all values, both whole and fractional, between and including all of the above, are hereby expressly contemplated for use herein.

In still other embodiments, the composition may include the following approximate weight ratios of percent actives of surfactants based on a total weight of the surfactant composition wherein the composition also includes the copolymer in an amount of from about 0.05 to about 1 weight percent actives based on a total weight of the composition. NaCl and/or KCl present in an amount of greater than about 0.5 and up to about 2, 3, 4, or 5, weight percent actives based on a total weight of the composition, and water present in an amount of at least about 60 weight percent based on a total weight of the composition.

| Surfactant 1 | Surfactant 2 | Surfactant 3 | Co-Polymer | NaCl/KCl |
|---|---|---|---|---|
| 0.440 | 0.166 | 0.394 | 0.05-1 | >0.5 to about 2 |
| 0.342 | 0.561 | 0.097 | 0.05-1 | >0.5 to about 2 |
| 0.098 | 0.722 | 0.180 | 0.05-1 | >0.5 to about 2 |
| 0.097 | 0.396 | 0.507 | 0.05-1 | >0.5 to about 2 |
| 0.290 | 0.411 | 0.299 | 0.05-1 | >0.5 to about 2 |
| 0.693 | 0.182 | 0.125 | 0.05-1 | >0.5 to about 2 |
| 0.177 | 0.116 | 0.708 | 0.05-1 | >0.5 to about 2 |
| 0.319 | 0.542 | 0.139 | 0.05-1 | >0.5 to about 2 |

In various non-limiting embodiments, all values, both whole and fractional, between and including all of the above, are hereby expressly contemplated for use herein.

EXAMPLES

Example 1

The following base (Composition 1) was made 12.55 percent total active surfactant:

| Material Description | Activity (%) | Composition 1 w/w (%) |
|---|---|---|
| Water | 100.00 | 50.000 |
| Citric Acid 50% solution | 50.00 | 8.800 |
| Triethanolamine | 85.00 | 1.482 |
| Alcohol Ethoxylate 25-7 Surfactant (2) | 100.00 | 6.802 |
| LAS Sulfonic acid Surfactant (3) | 96.00 | 1.817 |
| Coco Fatty Acid | 100.00 | 0.500 |
| Sodium Hydroxide | 50.00 | Adjust to pH 7.7 |
| Steol 25-3S/60 (AES) Surfactant (1) | 60.00 | 6.672 |
| Performance Polymer | 80.00 | 0.070 |
| Optical Brightener | 100.00 | 0.100 |
| Chelator | 34.00 | 0.735 |
| Preservative | 8.60 | 0.094 |
| DADMAC-Acrylic Acid Copolymer | 42.50 | 0.000 |
| Water | 100.00 | QS to 90 |
| | --Total-- | 90.000 |

Composition 1 then had the DADMAC-Acrylic Acid Copolymer added at different concentrations so as to form Compositions 2 to 9 to determine the turbidity impact of the polymer wherein additional water was added to each Composition as shown below. For instance, Composition 2 is the same as Composition 1 but with an additional 10% water added to the 90% base of Composition 1, notably with no copolymer and no salt. Composition 3 had 0.12% of DADMAC-Acrylic Acid Copolymer added as supplied (supplied as 42.5% active for 0.05% active polymer) plus 9.88% water added. The turbidity was measured using the instrumentation and method described in the detailed description above.

| Comp. | Amount of Comp. 1 Added | DADMAC-Acrylic Acid Copolymer (As Supplied as 42.5% Active) | DADMAC-Acrylic Acid Copolymer (Total % Active in the Composition) | Additional Water Added to Composition 1 to make formula 100 weigh percent | Turbidity NTU at 25° C. |
|---|---|---|---|---|---|
| 2 | 90 | 0 | 0 | 10 | 12.3 |
| 3 | 90 | 0.118 | 0.05 | 9.88 | 31.2 |
| 4 | 90 | 0.235 | 0.1 | 9.76 | 30.7 |
| 5 | 90 | 0.471 | 0.2 | 9.53 | 62.6 |

-continued

| Comp. | Amount of Comp. 1 Added | DADMAC-Acrylic Acid Copolymer (As Supplied as 42.5% Active) | DADMAC-Acrylic Acid Copolymer (Total % Active in the Composition) | Additional Water Added to Composition 1 to make formula 100 weigh percent | Turbidity NTU at 25° C. |
|---|---|---|---|---|---|
| 6 | 90 | 0.706 | 0.3 | 9.29 | 95.7 |
| 7 | 90 | 0.941 | 0.4 | 9.06 | 147 |
| 8 | 90 | 1.176 | 0.5 | 8.82 | 237 |
| 9 | 90 | 1.412 | 0.6 | 8.59 | 281 |

As shown in the table above, increasing the amount of DADMAC-Acrylic Acid Copolymer caused the turbidity of the solution to increase somewhat linearly.

Example 2: Improvements on Turbidity with Salt Additions

The following salts were added to Composition 10 (90 parts of Composition 1 plus 0.82 parts of DADMAC-Acrylic Acid as supplied (0.35% active) so as to form Compositions 11-28 as shown below. Any remaining parts of the formula after the salt addition was QS'd with Water to bring the formula to 100 parts (i.e. 100%). The turbidity was measured using the instrumentation and method described in the detailed description above.

| Composition | Salt Type | % Active Salt addition | Turbidity NTU at 25° C. |
|---|---|---|---|
| 11 | None | 0 | 105 |
| 12 | NaCl | 0.5 | 124 |
| 13* | NaCl | 0.75 | About 90-100 |
| 14 | NaCl | 1.0 | 71.4 |
| 15 | NaCl | 1.25 | 65.8 |
| 16 | NaCl | 1.5 | 56.7 |
| 17 | NaCl | 1.75 | 46.9 |
| 18 | NaCl | 2.0 | 36.9 |
| 19 | KCl | 0.5 | 118 |
| 20* | KCl | 0.75 | About 110-115 |
| 21 | KCl | 1 | 107 |
| 22* | KCl | 1.25 | About 100-105 |
| 23* | KCl | 1.5 | About 90-95 |
| 24* | KCl | 1.75 | About 80-85 |
| 25 | KCl | 2 | 76.6 |
| 26 | Potassium Citrate | 0.5 | 118 |
| 27 | Potassium Citrate | 1 | 121 |
| 28 | Potassium Citrate | 2 | 164 |

*Prophetic Examples

The above data demonstrates that potassium and sodium chloride were unexpectedly effective at reducing the turbidity of the formula below 80 NTU and at higher inclusion levels of sodium chloride, below 50 NTU. It was surprising that both 0.5 wt % of sodium chloride and 0.5 wt % potassium chloride worsened the turbidity of the formula. This, therefore, demonstrates an unexpected and superior synergy present in the instant disclosure.

Example 3: Additional Example

The following base (Composition 29) was made 15.13 percent total active surfactant:

| Material Description | Activity (%) | Composition 29 w/w (%) |
|---|---|---|
| Water | 100.00 | 50.000 |
| Citric Acid 50% solution | 50.00 | 8.800 |
| Triethanolamine | 85.00 | 1.482 |
| Alcohol Ethoxylate 25-7 Surfactant (1) | 100.00 | 5.159 |
| LAS Sulfonic acid Surfactant (3) | 96.00 | 3.909 |
| Coco Fatty Acid | 100.00 | 0.500 |
| Sodium Hydroxide | 50.00 | Adjust to pH 7.7 |
| Steol 25-3S/60 (AES) Surfactant (1) | 60.00 | 6.064 |
| Performance Polymer | 80.00 | 0.070 |
| Optical Brightener | 100.00 | 0.100 |
| Chelator | 34.00 | 0.735 |
| Preservative | 8.60 | 0.094 |
| DADMAC-Acrylic Acid Copolymer | 42.50 | 0.706 (i.e. 0.35% active co-polymer) |
| Water | 100.00 | QS to 90 |
| | --Total-- | 100.000 |

Composition 30 was 90 parts Composition 29 with 10 parts water. Composition 31 was 90 parts Composition 29 with 1.5% active sodium chloride (added as a 25% active solution), with the remaining parts being water. The turbidity of Composition 30 was 275 NTU and the turbidity of Composition 31 was 124 NTU. The turbidity was measured using the instrumentation and method described in the detailed description above. It was unexpected to discover the ratios of surfactants plus polymer that would yield turbid results, the impact of salt addition to improve transparency, and the amount of salt required.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration in any way. Rather, the foregoing detailed description will provide those skilled in the art with a convenient road map for implementing an exemplary embodiment. It being understood that various changes may be made in the function and arrangement of elements described in an exemplary embodiment without departing from the scope as set forth in the appended claims.

What is claimed is:

1. A detergent composition comprising:

A. a co-polymer of diallyldimethylammonium chloride and acrylic acid present in an amount of from about 0.2 to about 0.3 weight percent actives based on a total weight of said composition;

B. sodium and/or potassium chloride present in an amount of from about 1 up to about 5 weight percent actives based on a total weight of said composition;

C. a surfactant component present in an amount of from about 12 to about 13 weight percent actives based on a total weight of said composition and comprising:

(1) sodium laureth sulfate ethoxylated with about 2 to about 4 moles of ethylene oxide and present in an amount of from about 40 to about 50 weight percent actives based on a total weight of said surfactant component;

(2) a C12-C15 alcohol ethoxylate that is capped with about 7 moles of ethylene oxide present in an amount of from about 40 to about 50 weight percent actives based on a total weight of said surfactant component;

(3) a linear alkylbenzene sulfonate having a linear alkyl chain that has from about 10 to about 13 carbon atoms and present in an amount of from about 5 to about 15 weight percent actives based on a total weight of said surfactant component;

and

D. water present in a total amount of at least about 60 weight percent based on a total weight of said detergent; and wherein said detergent composition has a turbidity of less than about 80 NTU measured at 25° C. when sodium chloride is utilized to the exclusion of potassium chloride, a turbidity of less than about 110 NTU measured at 25° C. when potassium chloride is utilized to the exclusion of sodium chloride, and a turbidity of less than about 100 NTU measured at 25° C. when both sodium and potassium chloride are utilized.

2. The detergent composition of claim 1 wherein:

the sodium and/or potassium chloride is present in an amount of from about 1 to about 2 percent actives based on a total weight of said composition.

3. The detergent composition of claim 1 wherein sodium chloride is utilized to the exclusion of potassium chloride.

4. The detergent composition of claim 3 having a turbidity of less than about 40 NTU measured at 25° C.

5. The detergent composition of claim 1 having a turbidity of less than about 40 NTU measured at 25° C.

6. A detergent composition consisting essentially of:

A. a co-polymer of diallyldimethylammonium chloride and acrylic acid present in an amount of from about 0.2 to about 0.3 weight percent actives based on a total weight of said composition;

B. sodium chloride present in an amount of from about 1 to about 2 weight percent actives based on a total weight of said composition;

C. a surfactant component present in an amount of from about 12 to about 13 weight percent actives based on a total weight of said composition and comprising:

(1) sodium laureth sulfate ethoxylated with about 2 to about 4 moles of ethylene oxide and is present in an amount of from about 40 to about 50 weight percent actives based on a total weight of said surfactant component;

(2) a C12-C15 alcohol ethoxylate that is capped with about 7 moles of ethylene oxide and is present in an amount of from about 40 to about 50 weight percent actives based on a total weight of said surfactant component; and (3) a linear alkylbenzene sulfonate that has a linear alkyl chain that has from about 10 to about 13 carbon atoms and is present in an amount of from about 5 to about 15 weight percent actives based on a total weight of said surfactant component; and D. water present in a total amount of at least about 60 weight percent based on a total weight of said detergent; and wherein said detergent composition has a turbidity of less than about 72 NTU measured at 25° C.

7. The detergent composition of claim 1 wherein said sodium chloride is present in an amount of from about 1 to about 2 weight percent actives based on a total weight of said composition to the exclusion of potassium chloride.

8. The detergent composition of claim 1 wherein said detergent composition has a turbidity of less than about 72 NTU measured at 25° C.

9. The detergent composition of claim 1 wherein potassium chloride is utilized to the exclusion of sodium chloride.

10. The detergent composition of claim 1 wherein (1) The sodium laureth sulfate is present in an amount of from about 43 to about 44 weight percent actives based on a total weight of said surfactant component;

(2) the C12-C15 alcohol ethoxylate is present in an amount of from about 44 to about 45 weight percent actives based on a total weight of said surfactant component;

(3) the linear alkylbenzene sulfonate is present in an amount of from about 11 to about 12 weight percent actives based on a total weight of said surfactant component.

11. The detergent composition of claim 10 wherein said sodium chloride is present in an amount of from about 1 to about 2 weight percent actives based on a total weight of said composition to the exclusion of potassium chloride.

12. The detergent composition of claim 10 wherein said detergent composition has a turbidity of less than about 72 NTU measured at 25° C.

13. The detergent composition of claim 10 wherein potassium chloride is utilized to the exclusion of sodium chloride.

14. The detergent composition of claim 1 wherein (1) the sodium laureth sulfate is present in an amount of from about 43 to about 44 weight percent actives based on a total weight of said surfactant component.

15. The detergent composition of claim 1 wherein (2) the C12-C15 alcohol ethoxylate is present in an amount of from about 44 to about 45 weight percent actives based on a total weight of said surfactant component.

16. The detergent composition of claim 1 wherein (3) the linear alkylbenzene sulfonate is present in an amount of from about 11 to about 12 weight percent actives based on a total weight of said surfactant component.

* * * * *